US006629561B2

(12) United States Patent
Halt et al.

(10) Patent No.: US 6,629,561 B2
(45) Date of Patent: Oct. 7, 2003

(54) MODULE FOR A HEAT EXCHANGER HAVING IMPROVED THERMAL CHARACTERISTICS

(75) Inventors: David W. Halt, Milford, MI (US); David A. Starling, Ypsilanti, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 134 days.

(21) Appl. No.: 09/877,593

(22) Filed: Jun. 8, 2001

(65) Prior Publication Data

US 2002/0185264 A1 Dec. 12, 2002

(51) Int. Cl.[7] ..... F28F 3/08
(52) U.S. Cl. ..... 165/167; 165/153; 165/177
(58) Field of Search ..... 165/152, 153, 165/167, 177

(56) References Cited

U.S. PATENT DOCUMENTS

| | | | | | |
|---|---|---|---|---|---|
| 3,364,951 | A | * | 1/1968 | Burne et al. | 138/38 |
| 4,470,452 | A | * | 9/1984 | Rhodes | 165/153 |
| 4,572,766 | A | | 2/1986 | Dimitriou | 159/28.6 |
| 5,036,911 | A | * | 8/1991 | So et al. | 165/153 |
| 5,111,878 | A | | 5/1992 | Kadle | 165/176 |
| 5,125,453 | A | | 6/1992 | Bertrand et al. | 165/153 |
| 5,409,056 | A | | 4/1995 | Farry, Jr. et al. | 165/153 |
| 5,634,518 | A | * | 6/1997 | Burgers | 165/153 |
| 5,735,343 | A | * | 4/1998 | Kajikawa et al. | 165/153 |
| 5,771,964 | A | * | 6/1998 | Bae | 165/144 |
| 5,810,077 | A | | 9/1998 | Nakamura et al. | 165/153 |
| 6,250,380 | B1 | * | 6/2001 | Strahle et al. | 165/167 |

* cited by examiner

*Primary Examiner*—Allen Flanigan
(74) *Attorney, Agent, or Firm*—Brinks Hofer Gilson & Lione

(57) ABSTRACT

A module for a heat exchanger comprises a first generally planar member having a first opening at an opposite end with respect to a second opening. A second generally metallic planar member has a first opening at an opposite end with respect to a second opening. The first generally planar member may be aligned with the second generally planar member to form a cavity in communication with the first opening and the second opening. A pattern of elevated regions may extend from the first generally planar member and the second generally planar member. The pattern of elevated regions has a regional longitudinal axis that is tilted with respect to a reference longitudinal axis of at least one of the first generally planar member and the second generally planar member. A flow longitudinal axis may be tilted with respect to the reference longitudinal axis to facilitate a cross-flow of the fluid with respect to the elevated regions.

18 Claims, 4 Drawing Sheets

(1 of 4 Drawing Sheet(s) Filed in Color)

10

CONTOURS COLORED BY STATIC TEMPERATURE IN DEGREES KELVIN (K)

MODULE FOR A HEAT EXCHANGER HAVING IMPROVED THERMAL CHARACTERISTICS

FIELD OF THE INVENTION

This invention relates to a module for a heat exchanger having improved thermal characteristics.

BACKGROUND

In the prior art, a heat exchanger may be formed by sandwiching a series of plates together to form interconnected chambers for conveying a fluid. The exterior of the heat exchanger may be exposed to ambient temperatures, whereas the fluid in the heat exchanger may have a temperature that exceeds the ambient temperature. The plates may be equipped with ribs, beads, or fins to improve the heat-transfering ability of the plates to transfer thermal energy from the fluid in the heat exchanger to the ambient environment. To increase the ability of the heat exchanger to cool the fluid or to dissipate heat energy, the number of stages of the plates may be increased. However, as the number of the plates are increased, the pressure drop between the inlet and the outlet of the heat exchanger may decrease, which reduces the efficiency of the heat exchanger. Accordingly, a need exists to provide a compact heat exchanger with enhanced thermal performance that minimizes or reduces the number of stages or stacked plates of the heat exchanger to maintain efficiency.

SUMMARY

In accordance with the invention, a module for a heat exchanger comprises a first generally planar member having a first opening at an opposite end with respect to a second opening. A second generally planar member has a first opening at an opposite end with respect to a second opening. The first generally planar member may be arranged with the second generally planar member to form a cavity in communication with the first opening and the second opening. A pattern of elevated regions may extend from the first generally planar member and the second generally planar member. The pattern of elevated regions has a pattern longitudinal axis that is tilted with respect to a reference longitudinal axis of at least one of the first generally planar member and the second generally planar metallic member. A flow longitudinal axis may be tilted with respect to the reference longitudinal axis to facilitate a cross-flow of the fluid with respect to the elevated regions.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
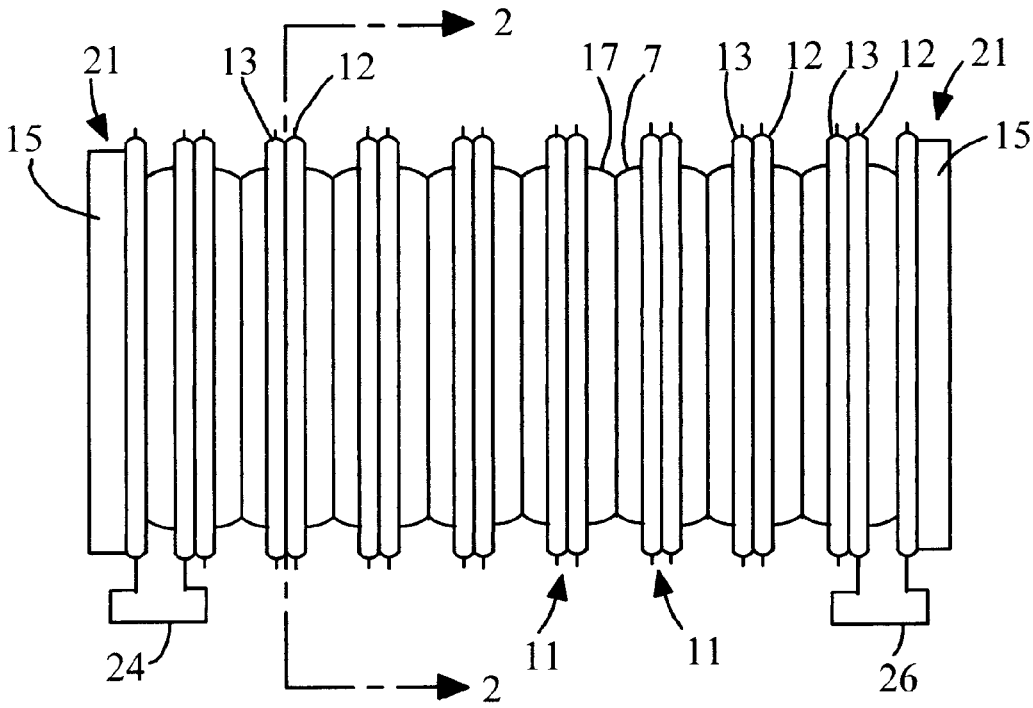
FIG. 1 is a top view of a heat exchanger in accordance with the invention.

In accordance with the invention, FIG. 1 shows a top view of a heat exchanger 10. The heat exchanger 10 is formed by interconnecting a series of modules 11 together. Each module 11 comprises a first generally planar member 12 joined to a second generally planar member 13. The modules 11 have mating flanges 17 for interconnection to one another. The mating flanges 17 may have openings to allow the passage of fluid between adjoining modules 11. In one embodiment, end modules 21 are connected to a rightmost module 11 and a leftmost module 11. Each end module 21 may be formed by a generally planar member joined to an end cap 15, for example.

The heat exchanger 10 has an inlet 24 and an outlet 26 for a fluid, such as a refrigerant. The fluid traverses an aggregate fluid path within the interior of the heat exchanger 10 from the inlet 24 to the outlet 26. If the fluid has a higher temperature or thermal energy level than the ambient air around the heat exchanger 10, the heat exchanger 10 may dissipate heat from the fluid while the fluid traverses the fluid path.

Figure 2:
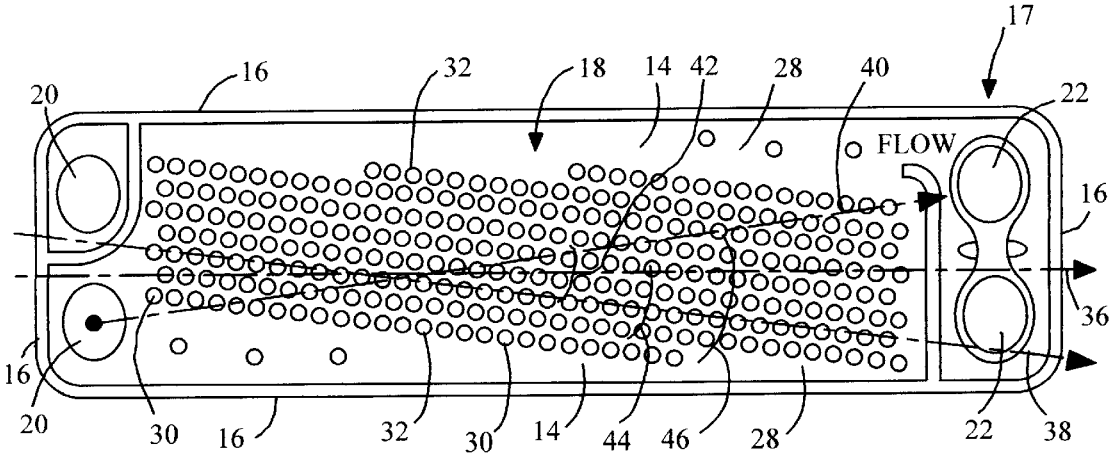
FIG. 2 is a first generally planar member as viewed along reference line 22 of FIG. 1.

FIG. 2 illustrates an example of a generally planar member 12 as viewed along reference line 2—2 of FIG. 1. Like reference numbers in FIG. 1 and FIG. 2 indicate like elements.

Each generally planar member (12 or 13) may have an interior surface 14 that is recessed with respect to edges 16 of the generally planar member (12 or 13) so as to form a pan. At least one first opening 20 is located at one end of the generally planar member (12 or 13). At least one second opening 22 is located at an opposite end with respect to the first opening 20.

The multiple planar members (12, 13) may be joined together about their edges 16 to form modules 11 with cavities between adjoining planar members (12, 13). For example, a pair of planar members (12, 13) are joined together with their interior surfaces 14 facing one another to form a cavity in communication with the first opening 20 and the second opening 22. The cavities are cascaded to form an aggregate flow path for the heat exchanger 10.

The interior surface 14 includes a pattern of elevated regions 18 extending from a recessed region 28 of the interior surface 14. The recessed region 28 represents a lower surface than those of elevated regions 18. In general, the elevated regions 18 refer to projections from the planar member 12 that are arranged to absorb thermal energy from the fluid and/or dissipate heat to the ambient environment around the heat exchanger 10. The elevated regions 18 may comprise beads, fins, spikes, ribs, or another elevated pattern that extends from at least one of the first generally planar member 12 and the second generally planar member 13.

The pattern of elevated regions 18 has a pattern longitudinal axis 38 that is tilted with respect to a reference longitudinal axis 36 of the generally planar member 12. The reference longitudinal axis 36 may be parallel to edges 16 or a perimetric dimension of the generally planar member (12 or 13). The pattern longitudinal axis 38 may form a first angle 42 with respect to the reference longitudinal axis 36.

A flow longitudinal axis 40 extends from the first opening 20 to the second opening 22 of the generally planar member 12. If the pattern longitudinal axis 38 is tilted in one angular direction with respect to the reference longitudinal axis 36, the flow longitudinal axis 40 may be tilted in the opposite angular direction with respect to the reference longitudinal axis 36. The flow longitudinal axis 40 forms a second angle 44 with respect to the reference longitudinal axis 36.

A cross-flow angle 46 is the sum of the first angle 42 and the second angle 44. The cross-flow angle 46 represents the angle of the flow of the fluid with respect to the elevated regions 18 in the interior of the cavity. The cross-flow angle 46 facilitates efficient transfer of thermal energy from the fluid to the ambient temperature.

In one embodiment, the fluid flowing from the inlet 24 to the outlet 26 takes a cross-directional path with respect to the pattern of the elevated regions 18 (e.g., beads) through each cavity. The geometry of the pattern of the elevated regions 18 and the relative direction of the fluid flow (e.g., refrigerant flow) enhances the heat dissipation of the heat exchanger 10. Accordingly, the heat exchanger 10 may be made more compact than otherwise possible without sacrificing performance of the heat exchanger 10.

In one embodiment as shown in FIG. 2, the pattern of elevated regions 18 may comprise a matrix of beads. The matrix of beads may comprise rows 30 and columns 32 of elevated regions 18 stamped or otherwise formed in a generally planar member 12. Adjacent rows 30 of the beads may be generally offset from one another by an offset distance of less than the bead spacing between adjacent beads in a single row 30. In one arrangement, beads may be defined in terms of beads per square inch or beads per other unit area of the interior surface 14.

The matrix of beads may be tilted with respect to the reference longitudinal axis 36. The perimeter of a matrix region defined by the matrix may deviate from a completely rectangular shape as shown in FIG. 2 because the tilt of the matrix region requires cropping of the matrix region to fit on the allotted area of the interior surface 14 of generally planar metallic member. The pattern longitudinal axis 38 may be parallel to a direction of a row 30 of the beads within the matrix of beads.

Figure 3:
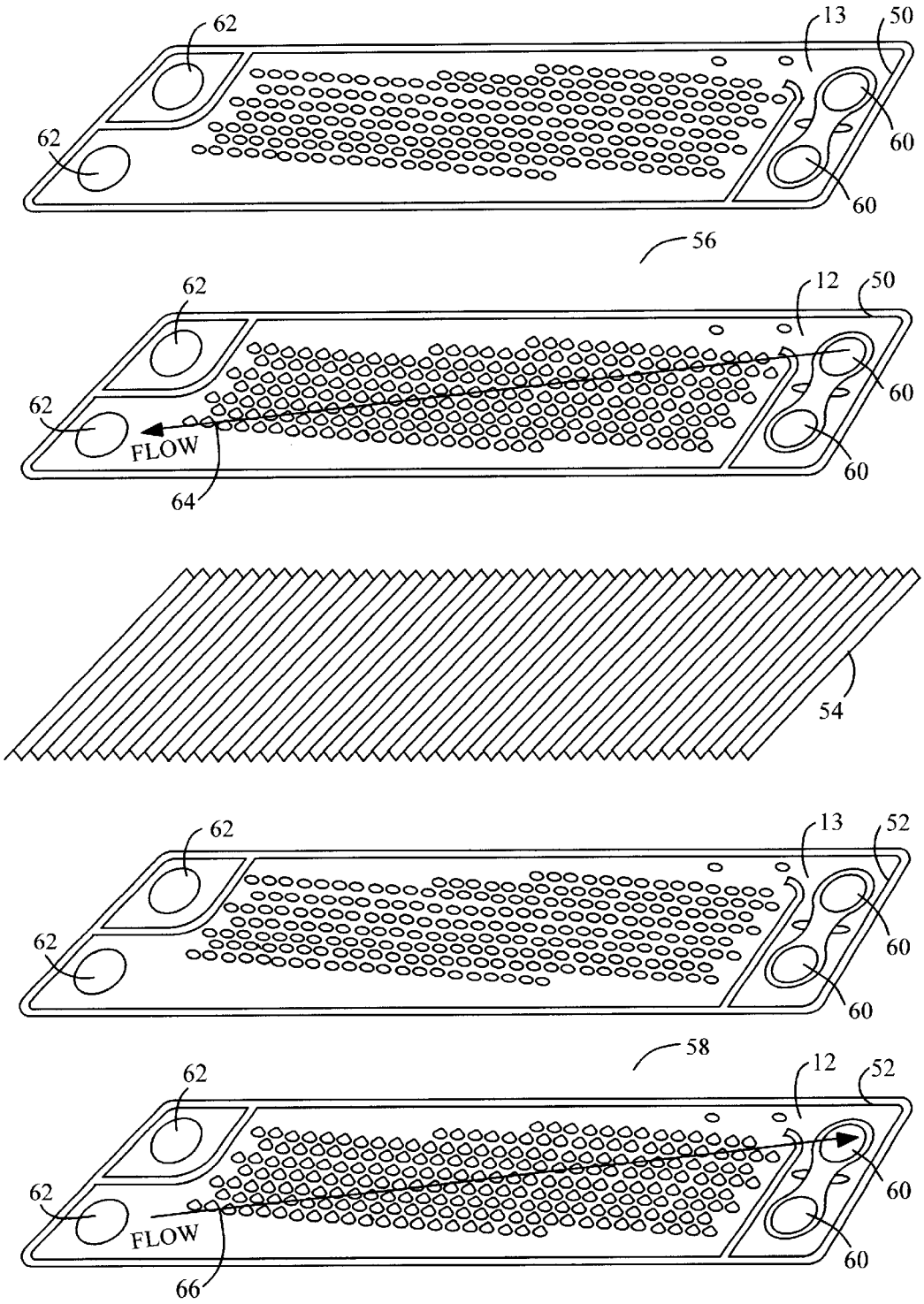
FIG. 3 is an exploded perspective view of a section of the heat exchanger of FIG. 1 in accordance with the invention.

FIG. 3 illustrates an exploded, perspective view of a section of a heat exchanger 10. The section shows modules 11 designated as a first module 50 and a second module 52.

The first module 50 may comprise a first pair of generally planar members (12, 13) that are joined together to form a first cavity 56. Similarly, the second module 52 may comprise a second pair of generally planar members (12, 13) that are joined together to form a second cavity 58. The first cavity 56 is cascaded with the second cavity 58 to form at least a portion of an aggregate internal flow path of the heat exchanger 10.

The first module 50 has at least one mating flange 17 formed by joining a set of first openings 20 of adjacent planar members (12, 13). Similarly, the second module 52 has at least one mating flange 17 formed by joining a set of second openings 22 of adjacent planar members (12, 13). The mating flanges 17 of adjacent modules (e.g., 50, 52) are arranged to communicate with one another such that the first cavity 56 within a first module 50 is cascaded with a second cavity 58 within a second module 52. The cavities may be arranged in tandem with a fluidic output of one cavity feeding a fluidic input of the next successive cavity such that the aggregate fluid path through the heat exchanger 10 may pass multiple matrixes of beads for improved cooling.

The first module 50 and the second module 52 are separated by a heat-sinking partition 54. The heat-sinking partition 54 may comprise a folded member that is bounded by adjacent modules 11 and mating flanges 17 (e.g., an upper mating flange and a lower mating flange).

Within each module, a cavity fluid path is defined between at least one first opening 20 and at least one second opening 22. The interior surface 14 forms a boundary of a cavity that is formed by joining a first generally planar member 12 with a second generally planar member 13 of each module 11. The pattern longitudinal axis 38 is tilted at a first angle with respect to the reference longitudinal axis 36. The cavity fluid path has a fluid longitudinal axis that is tilted at a second angle with respect to the reference longitudinal axis 36. The first angle plus the second angle equals a cross-flow angle. Accordingly, the fluid path represents a path of cross flow with respect to the pattern elevated regions 18 to enhance heat transfer capacity of the heat exchanger 10.

As shown in FIG. 3, the first cavity fluid path 64 follows a downward diagonal path for the first module 50 and the second cavity fluid path 66 follows an upward diagonal path for the second module 52. In practice, the first cavity fluid path 64 and the second fluid cavity path 66 may differ in direction or orientation from those shown, while still achieving a cross-flow of fluid across the elevated regions 18.

In one embodiment, the first generally planar member 12 and the second generally planar member 13 of each module 11 are composed of one or more of the following: aluminum, an aluminum alloy, a metal, a polymer, a polymer composite, a plastic, a plastic composite, and a metallic alloy. The edges 16 of the generally planar members (12, 13) may be bonded or fused together by a brazing process, a welding process or some other process. For example if the planar members (12, 13) are composed of aluminum or an aluminum alloy, the members may be joined by an aluminum-compatible brazing alloy. Although the heat exchanger 10 may be used in a great assortment of devices, in one embodiment the heat exchanger 10 may comprise an evaporator for a refrigeration system or an air-conditioning system. Further, the fluid conveyed within the cavities of the heat exchanger 10 from an inlet 24 to an outlet 26 may comprise a refrigerant such as freon or refrigerant R132a. Freon is a trademark of E. I. du Pont de Nemours and Company.

Although many different manufacturing processes may be used to make the module and heat exchanger 10, in one embodiment the heat exchanger 10 may be fabricated in accordance with continuously-corrugated manufacturing process. A continuously-corrugated manufacturing process may treat a roll or sheet stock of metal or a metallic alloy as a continuous roll. The roll or sheet stock is stamped in rapid succession after the continuously-corrugated feed stock is fed to an in-line press, for example. The stamped portions may be cut and aligned for bonding to one another. The stamped portions or generally planar members (12, 13) are bound together or held with clamps or some form of a jig. The held members (12, 13) are joined or fused together by welding, brazing, or otherwise connecting the generally planar member (12, 13).

The first openings 24 and the second openings 26 of adjacent pairs of generally planar members (12, 13) may be connected together by a brazing or welding process. A brazing process may be preferred to lower the heat required for the process and to simplify the reliability of the process by avoiding warping of the generally planar members (12, 13) from excessive heat exposure that might occur during a welding process.

Figure 4:
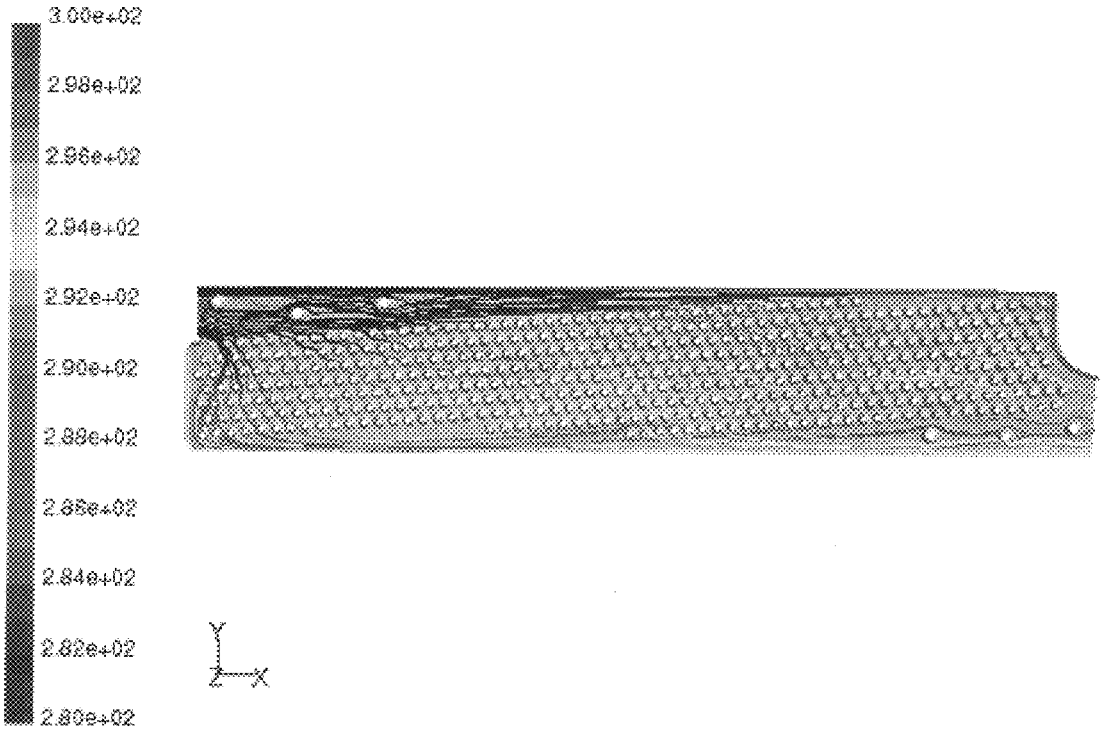
FIG. 4 is a color photograph of the thermal performance of a first generally planar member of the heat exchanger in accordance with the invention.

FIG. 4 is a color photograph that illustrates thermal performance of a generally planar member 12 while operating in the heat exchanger 10. FIG. 4 shows local temperature contours of the generally planar member 12 in degrees Kelvin. The colors of the contour regions may vary to indicate corresponding local temperatures. Although the local temperatures of the heat exchanger fall within the range of approximately 280 degrees Kelvin to approximately 300 degrees Kelvin, the heat exchanger 10 is not limited to any particular range of local temperatures. The thermal contour of FIG. 4 illustrates that heat is dissipated efficiently by the pattern of elevated regions 18, whereas heat accumulates where the elevated regions 18 are absent.

In sum, the heat exchanger 10 and its constituent module 11 represents a thermally efficient heat exchanger 10 that may be employed as a compact evaporator for automotive or vehicular applications, for example. The compact size of the heat exchanger 10 may be achieved by using the cross-flow alignment of fluid (e.g., refrigerant) of fluid across the pattern of elevated regions 18 to minimize the dimensions (e.g., thickness) of the heat exchanger 10.

The foregoing description of the heat exchanger describes several illustrative examples of the invention. Modifications, alternate arrangements, and variations of these illustrative examples are possible and may fall within the scope of the invention. Accordingly, the following claims should be accorded the reasonably broadest interpretation which is consistent with the specification disclosed herein and not unduly limited by aspects of the preferred embodiments disclosed herein.

The following is claimed:

1. A module for a heat exchanger, the module comprising:

a first generally planar member having a first opening at an opposite end with respect to a second opening;

a second generally planar member having a first opening at an opposite end with respect to a second opening, the first generally planar member being oriented with respect to the second generally planar member to form a cavity in communication with the first opening and the second opening; and a pattern of elevated regions having a pattern longitudinal axis that is tilted with respect to a reference longitudinal axis of at least one of the first generally planar member and the second generally planar member, wherein the pattern of elevated regions comprises a matrix of rows and columns of elevated regions wherein adjacent rows are offset from one another by an offset distance that is less than a spacing between adjacent elevated regions within a row.

2. The module for the heat exchanger according to claim 1 wherein a fluid path is defined between the first opening and the second opening, the fluid path having a fluid longitudinal axis that is tilted with respect the reference longitudinal axis in an opposite direction of rotation with respect to the tilt of the pattern longitudinal axis.

3. The module for the heat exchanger according to claim 1 wherein the fluid path is defined between the first opening and the second opening, the fluid path having a fluid longitudinal axis that supports a cross-flow of fluid across the elevated regions.

4. The module for the heat exchanger according to claim 1 wherein the pattern of elevated regions comprise a matrix of beads formed on an interior surface of the first generally planar member.

5. The module for the heat exchanger according to claim 1 wherein the pattern of elevated regions comprises a matrix of beads, the matrix having rows and columns of the beads stamped in the first generally planar member.

6. The module for the heat exchanger according to claim 5 wherein the matrix comprises adjacent rows being offset from one another by an offset distance.

7. The module for the heat exchanger according to claim 1 wherein the pattern is tilted with respect to the reference longitudinal axis and wherein a perimeter of the pattern deviates from a completely rectangular shape to fit on a first generally planar member having a generally rectangular shape.

8. The module for the heat exchanger according to claim 1 wherein the first generally planar member and the second generally planar member are composed of at least one of aluminum and an aluminum alloy.

9. The module for a heat exchanger according to claim 1 wherein the heat exchanger comprises an evaporator for a refrigeration system and wherein a fluid conveyed within the cavity between the first opening and the second opening.

10. A heat exchanger comprising:

a first pair of generally planar members, each having a first opening at an opposite end with respect to a second opening, the first pair of generally planar members joined to one another at least near their perimeters to form a first cavity in communication with the first opening and the second opening;

a second pair of generally planar members, each having a first opening at an opposite end with respect to a second opening, the second pair of generally planar members joined to one another at least near their perimeters to form a second cavity in communication with the first opening and the second opening, the first cavity cascaded with the second cavity; and a pattern of elevated regions having a pattern longitudinal axis that is tilted with respect to a reference longitudinal axis of at least one of the first pair and the second pair, wherein the pattern of elevated regions comprises a matrix of rows and columns of elevated regions wherein adjacent rows are offset from one another by an offset distance that is less than a spacing between adjacent elevated regions within a row.

11. The heat exchanger according to claim 10 wherein a fluid path is defined between the first opening of one of the first pair of generally planar members and the second opening of the one of the first pair of generally planar members, the fluid path having a fluid longitudinal axis that is tilted with respect the reference longitudinal axis in an opposite angular direction of rotation with respect to the tilt of the pattern longitudinal axis.

12. The heat exchanger according to claim 10 wherein the fluid path is defined between the first opening of one of the first pair of generally planar members and the second opening of the one of the first pair of generally planar members, the fluid path having a fluid longitudinal axis to support a cross-flow of fluid across the pattern of elevated regions.

13. The heat exchanger according to claim 10 wherein the pattern of elevated regions comprises a matrix of beads formed in at least one of the first pair of generally planar members.

14. The heat exchanger according to claim 13 wherein the matrix of beads comprises rows and columns of beads stamped in the at least one of the first pair of generally planar members.

15. A heat exchanger comprising:

a first pair of generally planar members, each having a first opening at an opposite end with respect to a second opening, the first pair of generally planar members joined to one another at least near their perimeters to form a first cavity in communication with the first opening and the second opening;

a second pair of generally planar members, each having a first opening at an opposite end with respect to a second opening, the second pair of generally planar members joined to one another at least near their perimeters to form a second cavity in communication with the first opening and the second opening, the first cavity cascaded with the second cavity;

a pattern of elevated regions having a pattern longitudinal axis that is tilted with respect to a reference longitudinal axis of at least one of the first pair and the second pair, wherein the pattern of elevated regions comprises a matrix of beads formed in at least one of the first pair of generally planar members and wherein the matrix of beads comprises rows and columns of beads stamped in the at least one of the first pair of generally planar members; and wherein the matrix has adjacent rows offset from one another by an offset distance that is less than a spacing between adjacent beads within a row.

16. The heat exchanger according to claim 10 wherein the pattern is tilted with respect to the reference longitudinal axis and wherein a perimeter of the pattern deviates from a completely rectangular shape.

17. The heat exchanger according to claim 10 wherein the first pair of generally planar members and the second pair of generally planar members are composed of at least one of aluminum and an aluminum alloy.

18. The heat exchanger according to claim 10 wherein the heat exchanger comprises an inlet and an outlet, the first cavity arranged to receive fluid from the inlet and the second cavity arranged to direct the fluid toward the outlet, the heat exchanger comprising an evaporator for a refrigeration system and the fluid composed of a refrigerant.

* * * * *